US006534779B1

(12) United States Patent
Kohda et al.

(10) Patent No.: US 6,534,779 B1
(45) **Date of Patent: *Mar. 18, 2003**

(54) CONVEYANCE OF STIMULABLE PHOSPHOR SHEET

(75) Inventors: Katsuhiro Kohda, Kanagawa (JP); Masakazu Nakajo, Kanagawa (JP); Hideki Suzuki, Kanagawa (JP); Hiroshi Chikugo, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/503,507

(22) Filed: Feb. 14, 2000

(30) Foreign Application Priority Data

| | | |
|---|---|---|
| Feb. 12, 1999 | (JP) | 11-034840 |
| Feb. 12, 1999 | (JP) | 11-034841 |
| Feb. 12, 1999 | (JP) | 11-034842 |
| Jul. 22, 1999 | (JP) | 11-207529 |

(51) Int. Cl.[7] ..... G03B 42/02; B65H 5/06

(52) U.S. Cl. ..... 250/589; 271/272; 271/274

(58) Field of Search ..... 250/589, 590; 271/274, 272, 225, 238, 240, 247, 252

(56) References Cited

U.S. PATENT DOCUMENTS

| | | | | | |
|---|---|---|---|---|---|
| 4,667,102 | A | * | 5/1987 | Koyama et al. | 250/589 |
| 4,848,765 | A | * | 7/1989 | Torii | 271/274 |
| 4,996,542 | A | * | 2/1991 | Ohgoda et al. | 347/262 |
| 5,091,754 | A | * | 2/1992 | Abe et al. | 355/317 |
| 5,736,746 | A | * | 4/1998 | Furutoh | 250/589 |
| 6,339,226 | B1 | * | 1/2002 | Chikugo | 250/589 |
| 2001/0019113 | A1 | * | 9/2001 | Tajima et al. | 250/582 |

FOREIGN PATENT DOCUMENTS

| | | | | |
|---|---|---|---|---|
| EP | 0 159 613 B1 | * | 9/1992 | G21K/4/00 |

* cited by examiner

*Primary Examiner*—Constantine Hannaher
*Assistant Examiner*—Albert Gagliardi
(74) *Attorney, Agent, or Firm*—Sughrue Mion, PLLC

(57) ABSTRACT

An apparatus for conveying a rectangular stimulable phosphor sheet with change of its conveyed course composed of a pair of longitudinal guide plates curved to form an arc, each guide plate being arranged in parallel to each other with a space approximately corresponding to the width of the phosphor sheet; a series of rollers which are so arranged along each of the guide plates to allow advancement of the phosphor sheet between a guide space formed by the guide plate and these rollers; and a pair of driving rollers which are arranged in the vicinity of one ends on imaginary plane extended from the pair of the curved guide plates.

9 Claims, 9 Drawing Sheets

CONVEYANCE OF STIMULABLE PHOSPHOR SHEET

FIELD OF THE INVENTION

The present invention relates to an apparatus and a method for conveying a rectangular stimulable phosphor sheet which is favorably employable for conveying the stimulable phosphor sheet with change of its conveyed course in a radiation image recording and reproducing system.

BACKGROUND OF THE INVENTION

As a method replacing a conventional radiography, a radiation image recording and reproducing method utilizing a stimulable phosphor was proposed and has been practically employed. The method employs a rectangular stimulable phosphor sheet (i.e., rectangular radiation image storage panel) comprising a stimulable phosphor, and comprises the steps of causing the stimulable phosphor of the phosphor sheet to absorb radiation energy having passed through an object or having radiated from an object; sequentially exciting the stimulable phosphor with stimulating rays to release the radiation energy stored in the phosphor as light emission (i.e., stimulated emission); photoelectrically detecting the stimulated emission to obtain electric signals; and reproducing the radiation image of the object as a visible image from the electric signals. The phosphor sheet thus treated is then subjected to a step for erasing a radiation image remaining therein, and then stored for the next recording and reproducing procedure. Thus, the stimulable phosphor sheet can be repeatedly employed.

The stimulable phosphor sheet has a basic structure comprising a support and a stimulable phosphor layer provided thereon. If the phosphor layer is self-supporting, the support may be omitted. On the free surface (surface not facing the support) of the phosphor layer, a transparent protective film is generally placed to keep the phosphor layer from chemical deterioration or physical damage.

As is described above, the stimulable phosphor sheet is conveyed step by step for being subjected to various procedures such as irradiation with radiation such as X-rays for recording the radiation image, irradiation with stimulating rays for reading the recorded radiation image, and erasure of radiation energy remaining in the phosphor sheet by applying thereto the erasing light.

In the early stage of the development of radiation image storing and reproducing system, each of the recording procedure, reading procedure, and erasing procedure was performed in a separately manufactured apparatus specifically designed for each procedure. The stimulable phosphor sheet was manually transferred from one apparatus to other apparatuses. In each apparatus, the phosphor sheet was conveyed by a conveyor belt almost in the horizontal direction.

A recently developed compact automated apparatus for performing the radiation image storing and reproducing system affords performing all related procedures within the compact apparatus. In other words, the recording procedure, reading procedure and erasing procedure are all performed in one compact apparatus. In the compact apparatus, the stimulable phosphor sheet is conveyed not only horizontally but also vertically. Moreover, the stimulable phosphor sheet should be turned with sharp angles in such a mode as 90 degree-turn or 180 degree-turn from the horizontal movement to the vertical movement and vice versa.

Published European Patent Specification of EP 0 159 613 B1 describes a device conveying a stimulable phosphor sheet in the vertical direction which comprises two guiding members arranged parallel in substantially vertical direction and a plurality of driving members in the form of rotatable rollers wherein the axis of rotation of the driving members is arranged in a substantially horizontal direction and wherein the distance between two driving members adjoining each other along the vertical direction is smaller than the length of said stimulable phosphor sheet, characterized in that the driving members are rotatable rollers being arranged in pairs, that the phosphor sheet is to be engaged between said pair of driving members, that at least one member of each pair of driving members is connected to a motor and the guiding members are U-shaped and have a distance to each other at least of the transverse dimension of the phosphor sheet for keeping both edges of the phosphor sheet.

The conveying device described in the published EP specification can be employed for conveying the stimulable phosphor sheet in the vertical direction in a radiation image recording and reproducing system. In the published specification, however, no means are described for conveying the stimulable phosphor sheet with change of its conveyed course.

SUMMARY OF THE INVENTION

It is an object of the present invention to provide an apparatus for conveying a stimulable phosphor sheet with change of its conveyed course such as 90-degree turn mode or 180-degree turn mode in a radiation image recording and reproducing method.

It is another object of the invention to provide a method for conveying a stimulable phosphor sheet with change of its conveyed course such as 90-degree turn mode or 180-degree turn mode in a radiation image recording and reproducing method.

The present invention resides in an apparatus for conveying a rectangular stimulable phosphor sheet with change of its conveyed course which comprises:

a pair of longitudinal guide plates curved to form an arc, each guide plate being arranged in parallel to each other with a space approximately corresponding to the width of the phosphor sheet;

a series of rollers which are so arranged along each of the guide plates to allow advancement of the phosphor sheet between a guide space formed by the guide plate and these rollers; and a pair of driving rollers which are arranged in the vicinity of one ends on imaginary plane extended from the pair of the curved guide plates.

The conveying apparatus of the invention preferably further comprises another pair of driving rollers which are arranged in the vicinity of another ends on imaginary plane extended from the pair of the curved guide plates.

The present invention also resides in a method of conveying a rectangular stimulable phosphor sheet with change of its conveyed course by means of a pair of longitudinal guide plates curved to form an arc, each guide plate being arranged in parallel to each other with a space approximately corresponding to the width of the phosphor sheet; a series of rollers which are so arranged along each of the guide plates to allow advancement of the phosphor sheet between a guide space formed by the guide plate and these rollers; a pair of driving rollers which are arranged in the vicinity of one ends on imaginary plane extended from the pair of the curved guide plates, and another pair of driving rollers which are arranged in the vicinity of another ends on imaginary plane extended from the pair of the curved guide plates which comprises the steps of:

drawing the phosphor sheet into the guide space by rotating the driving rollers arranged in the vicinity of one ends and keeping both sides of the phosphor sheet between the guide space;

advancing the phosphor sheet by continuing the rotation of the driving rollers and keeping both sides of the phosphor sheet between the guide spaces;

advancing the phosphor sheet by rotating the driving rollers arranged in the vicinity of another ends and keeping both sides of the phosphor sheet between the guide spaces; and drawing the phosphor sheet out of the guide spaces by rotating the driving rollers arranged in the vicinity of another ends and keeping both sides of the phosphor sheet between the guide spaces.

The invention further resides in a method of conveying a rectangular stimulable phosphor sheet whose forward end is retracted at its center area, with change of its conveyed course in an apparatus comprising a pair of longitudinal guide plates curved to form an arc, each guide plate being arranged in parallel to each other with a space approximately corresponding to the width of the phosphor sheet; a series of rollers which are so arranged along each of the guide plates to allow advancement of the phosphor sheet between a guide space formed by the guide plate and these rollers; a pair of driving rollers which are arranged in the vicinity of one ends on imaginary plane extended from the pair of the curved guide plates, and another pair of driving rollers which are arranged in the vicinity of another ends on imaginary plane extended from the pair of the curved guide plates which comprises the steps of:

drawing the phosphor sheet into the guide space by rotating the driving rollers arranged in the vicinity of one ends and keeping both sides of the phosphor sheet between the guide space;

advancing the phosphor sheet by continuing the rotation of the driving rollers and keeping both sides of the phosphor sheet between the guide spaces;

advancing the phosphor sheet by rotating the driving rollers arranged in the vicinity of another ends and keeping both sides of the phosphor sheet between the guide spaces; and drawing the phosphor sheet out of the guide spaces by rotating the driving rollers arranged in the vicinity of another ends and keeping both sides of the phosphor sheet between the guide spaces.

The invention furthermore resides in a method of conveying a rectangular stimulable phosphor sheet whose flexibility in its conveying direction is higher than flexibility in its width direction, with change of its conveyed course in an apparatus comprising a pair of longitudinal guide plates curved to form an arc, each guide plate being arranged in parallel to each other with a space approximately corresponding to the width of the phosphor sheet; a series of rollers which are so arranged along each of the guide plates to allow advancement of the phosphor sheet between a guide space formed by the guide plate and these rollers; a pair of driving rollers which are arranged in the vicinity of one ends on imaginary plane extended from the pair of the curved guide plates, and another pair of driving rollers which are arranged in the vicinity of another ends on imaginary plane extended from the pair of the curved guide plates which comprises the steps of:

drawing the phosphor sheet into the guide space by rotating the driving rollers arranged in the vicinity of one ends and keeping both sides of the phosphor sheet between the guide space;

advancing the phosphor sheet by continuing the rotation of the driving rollers and keeping both sides of the phosphor sheet between the guide spaces;

advancing the phosphor sheet by rotating the driving rollers arranged in the vicinity of another ends and keeping both sides of the phosphor sheet between the guide spaces; and drawing the phosphor sheet out of the guide spaces by rotating the driving rollers arranged in the vicinity of another ends and keeping both sides of the phosphor sheet between the guide spaces.

DETAILED DESCRIPTION OF THE INVENTION

The present invention is further described by referring to the attached drawings.

Figure 1:
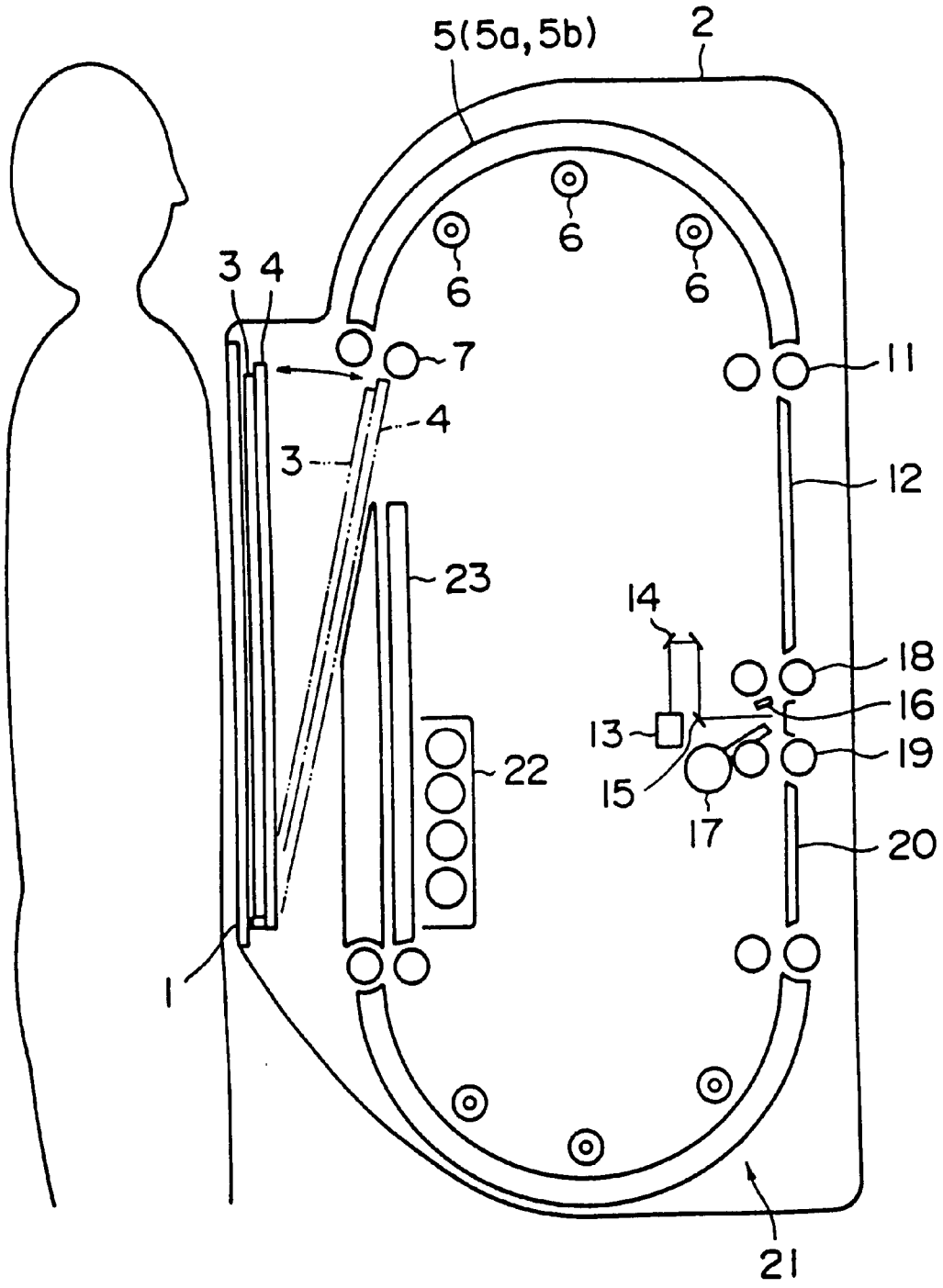
FIG. 1 schematically illustrates an apparatus for the radiation image recording and reproducing system in which a stimulable phosphor sheet is conveyed with change of its conveyed course according to the invention.

FIG. 1 schematically illustrates an apparatus for performing the radiation image recording and reproducing system in which a stimulable phosphor sheet is conveyed with change of its conveyed course according to the invention.

The apparatus of FIG. 1 has a housing 2 equipped with a plate 1 for receiving X-rays transmitted through a human body. Onto the inner side of the plate 1, a rectangular stimulable phosphor sheet 3 is pressed by a pressing plate 4.

When the irradiation of X-rays to the human body is complete, the pressing plate 4 is turned back slightly to the position for releasing the pressure having been applied to the phosphor sheet 3. The phosphor sheet 3 is then pushed up by a push-up means equipped to the lower portion of the pressing plate 4 to elevate for engagement with the means for conveying the phosphor sheet with 180-degree turn. The conveying means for 180 degree turn are illustrated in detail in FIG. 2.

The means or apparatus of the invention for conveying a rectangular stimulable phosphor sheet with change of its conveyed course comprises:

a pair of longitudinal guide plates S (5*a,* 5*b*) which are curved to form an arc, each guide plate 5 (5*a,* 5*b*) being arranged in parallel to each other with a space approximately corresponding to the width of the phosphor sheet 3;

a series of rollers 6 which are so arranged along each of the guide plates 5 (5*a,* 5*b*) to allow advancement of the phosphor sheet 3 between a guide space formed by the guide plate S (5*a,* 5*b*) and these rollers 6; and a pair of driving rollers 7 which are arranged in the vicinity of one ends on imaginary plane extended from the pair of the curved guide plates 5 (5*a,* 5*b*).

The pair of driving rollers 7 are connected via a connecting shaft 8 to each other, and apply driving force onto the both side portions of the phosphor sheet 3 to move the phosphor sheet forward into the guide spaces formed by the guide plates 5 (5*a,* 5*b*) and the series of rollers 6. The driving force is given from a driving motor 9 by way of a timing belt 10.

Within the apparatus of FIG. 1, the phosphor sheet 3 is returned back to the original position shown in FIG. 1 in the same route, after it is subjected to the radiation image reading procedure and the erasing procedure. Accordingly, the driving rollers 7 are designed to rotate in both directions to move the phosphor sheet 3 forward or backward with the predetermined timing.

Generally, the rollers 6 are free rollers which freely rotate according to the movement of the phosphor sheet 3.

Figure 3:
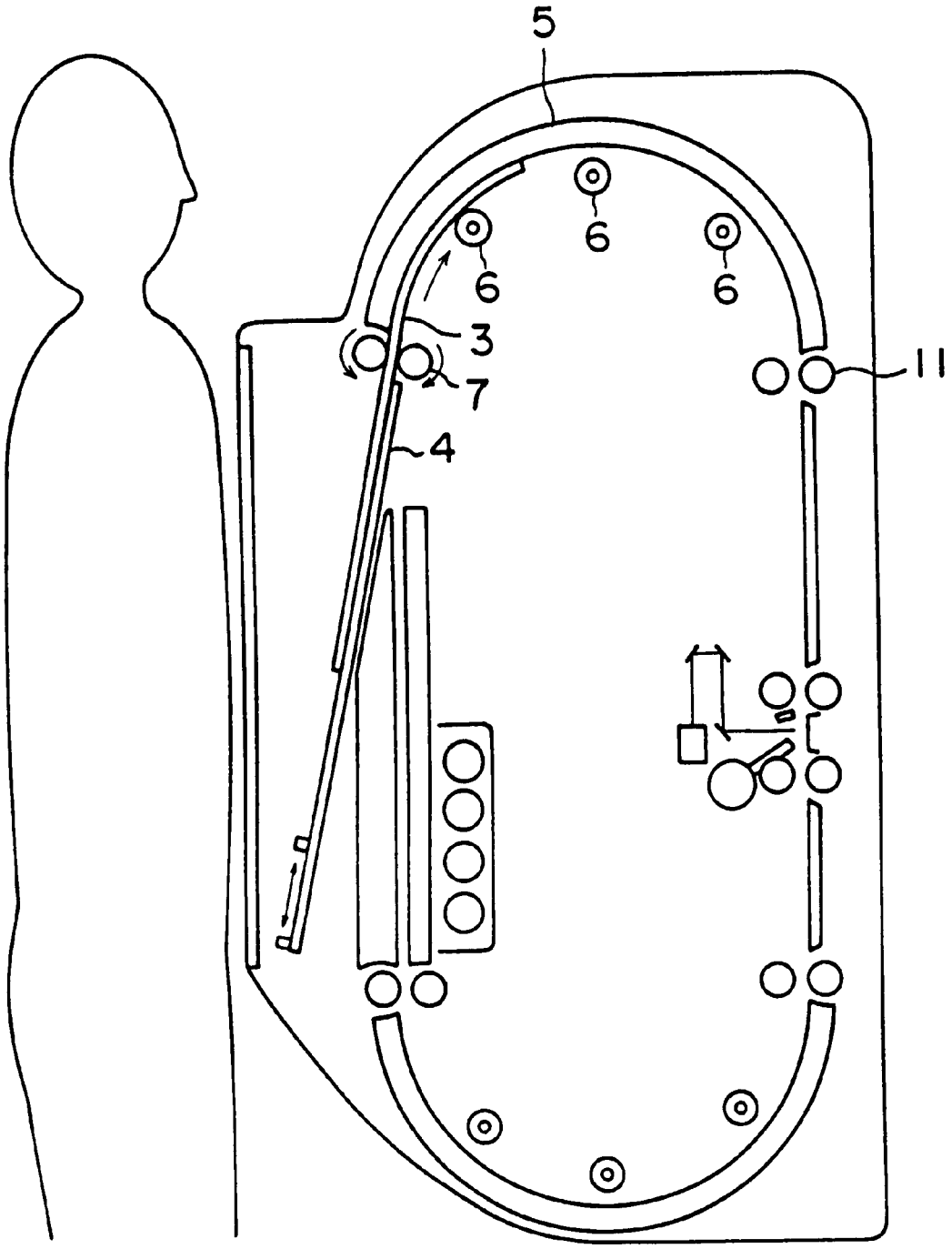
FIG. 3 schematically illustrates an apparatus corresponding to the apparatus of FIG. 1, in which the stimulable phosphor sheet is drawn into the conveying mechanism of FIG. 2.

FIG. 3 illustrates the condition that the phosphor sheet 3 engaged with the driving rollers 7 is conveyed forward along the guide plates 5 by the driving force supplied by the driving rollers 7. Preferably, the conveying apparatus has another pair of driving rollers 11 in the vicinity of another ends on imaginary plane extended from the pair of the curved guide plates 5. The driving rollers 11 work for guiding the phosphor sheet 3 to move out of the guide space.

Figure 2:
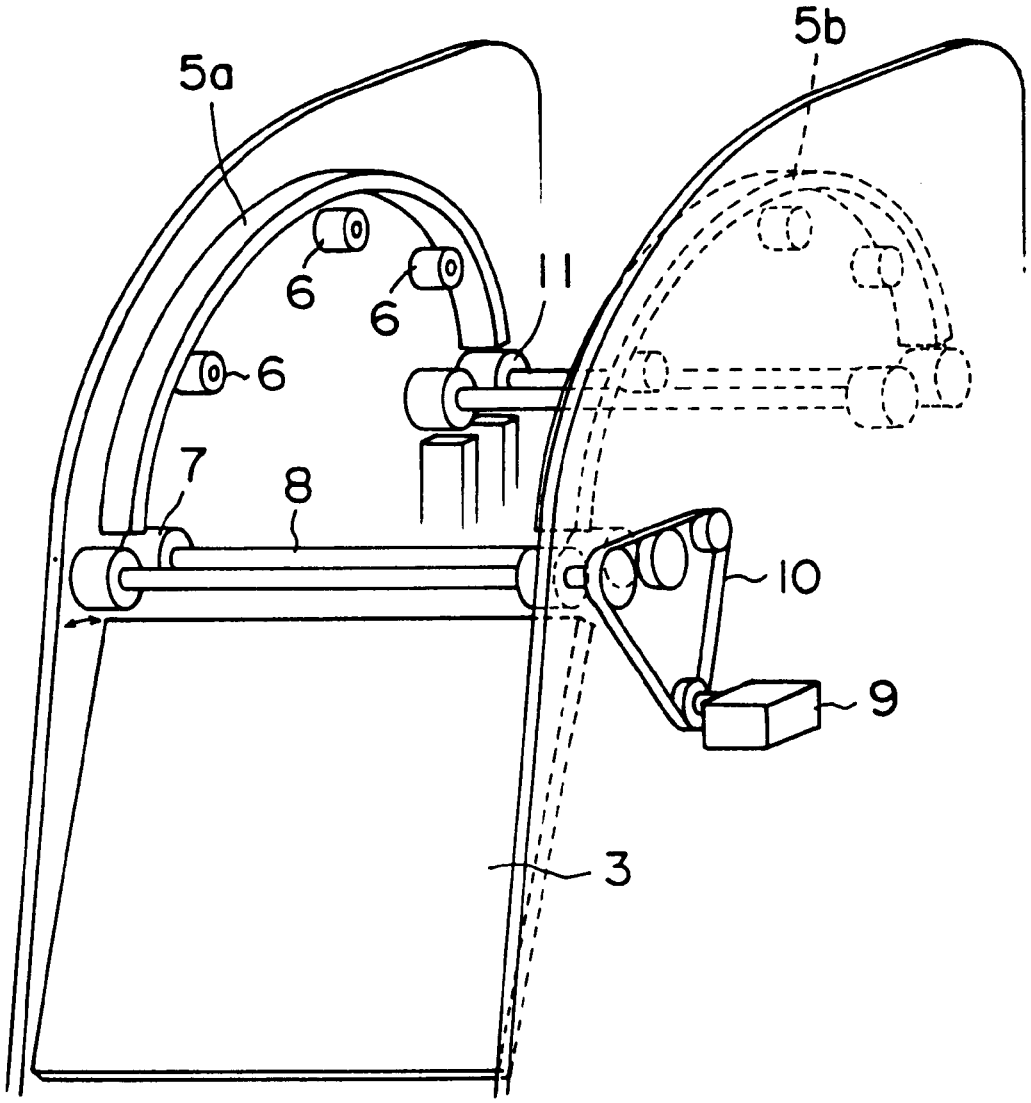
FIG. 2 is a schematic view which illustrates a mechanism of conveying the phosphor sheet with change of its conveyed course.
Figure 4:
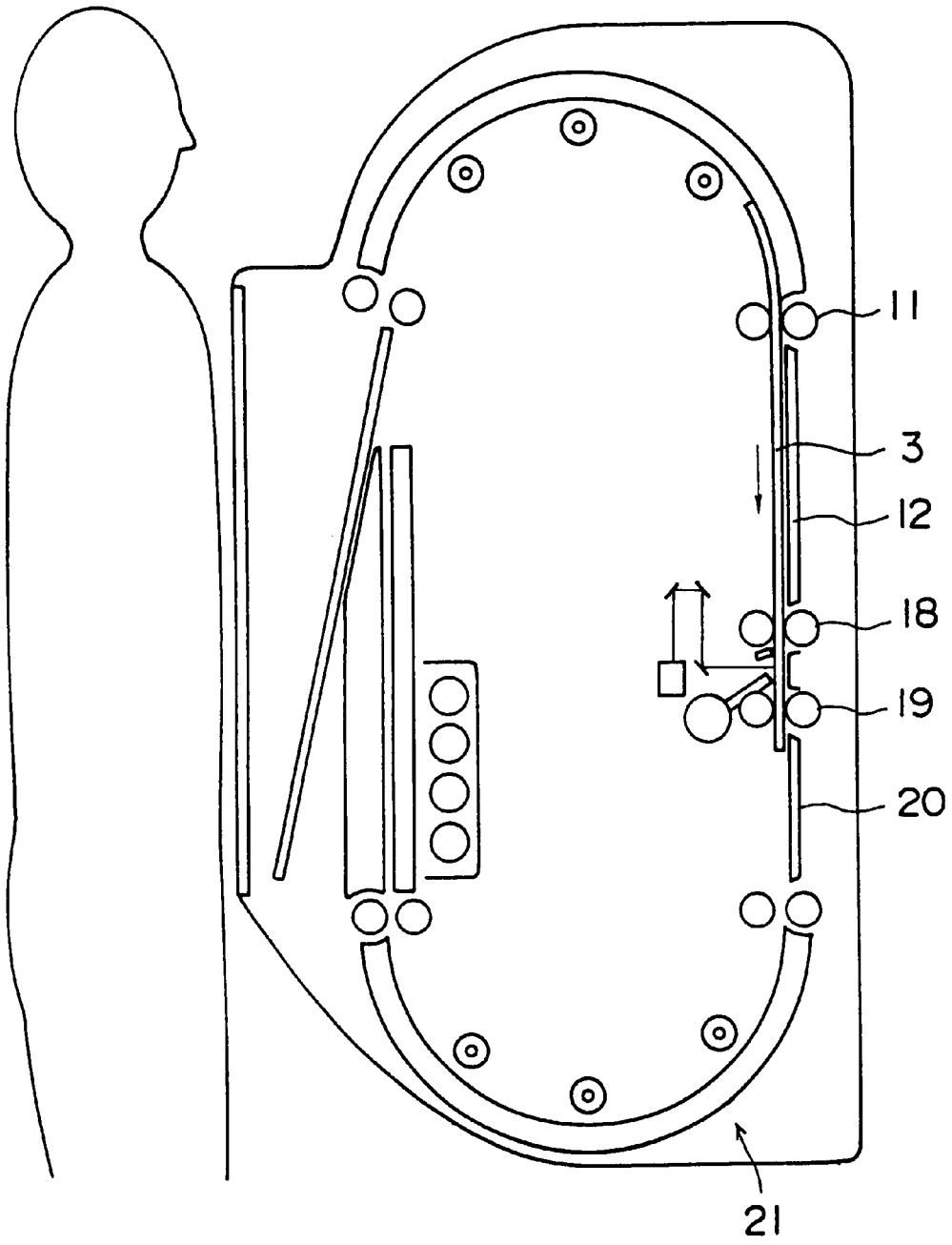
FIG. 4 schematically illustrates an apparatus corresponding to the apparatus of FIG. 1, in which the stimulable phosphor sheet is drawn out of the conveying mechanism of FIG. 2 and then is subjected to the radiation image reading procedure.

As is illustrated in FIG. 4, the conveyed phosphor sheet is then engaged with the driving rollers 11 at its side portions and is further moved forward to be released from the guide plates 5. Since the conveying apparatus of FIG. 2 is designed to convey the phosphor sheet with 180-degree turn, the released phosphor sheet 3 descends from the exit of the guide plates 5. The descending movement is smoothly performed under engagement with the driving rollers 11. The phosphor sheet 3 further descends smoothly by the aid of a guide plate 12 for guiding both side portions of the phosphor sheet 3, and is guided to reach the stage in which a device for reading a radiation image from the phosphor sheet is placed. The reading device comprises a semiconductor laser source 13, polygon 14, a mirror 15 for changing the direction of laser light, a mirror 16 for collection of stimulated emission, and a photomultiplier 17.

The descending phosphor sheet 3 is then guided by the driving rollers 18, 19 which are arranged in the positions prior to and after the reading device. In the radiation image reading stage, the radiation image recorded in the phosphor sheet 3 is read out. Subsequently, the phosphor sheet 3 further descends by the aid of a guide plate 20 for guiding both side portions of the phosphor sheet.

At the bottom of the housing, there is installed a means 21 for conveying the phosphor sheet with 180-degree turn, which is almost the same as the aforementioned means but arranged upside-down.

Figure 5:
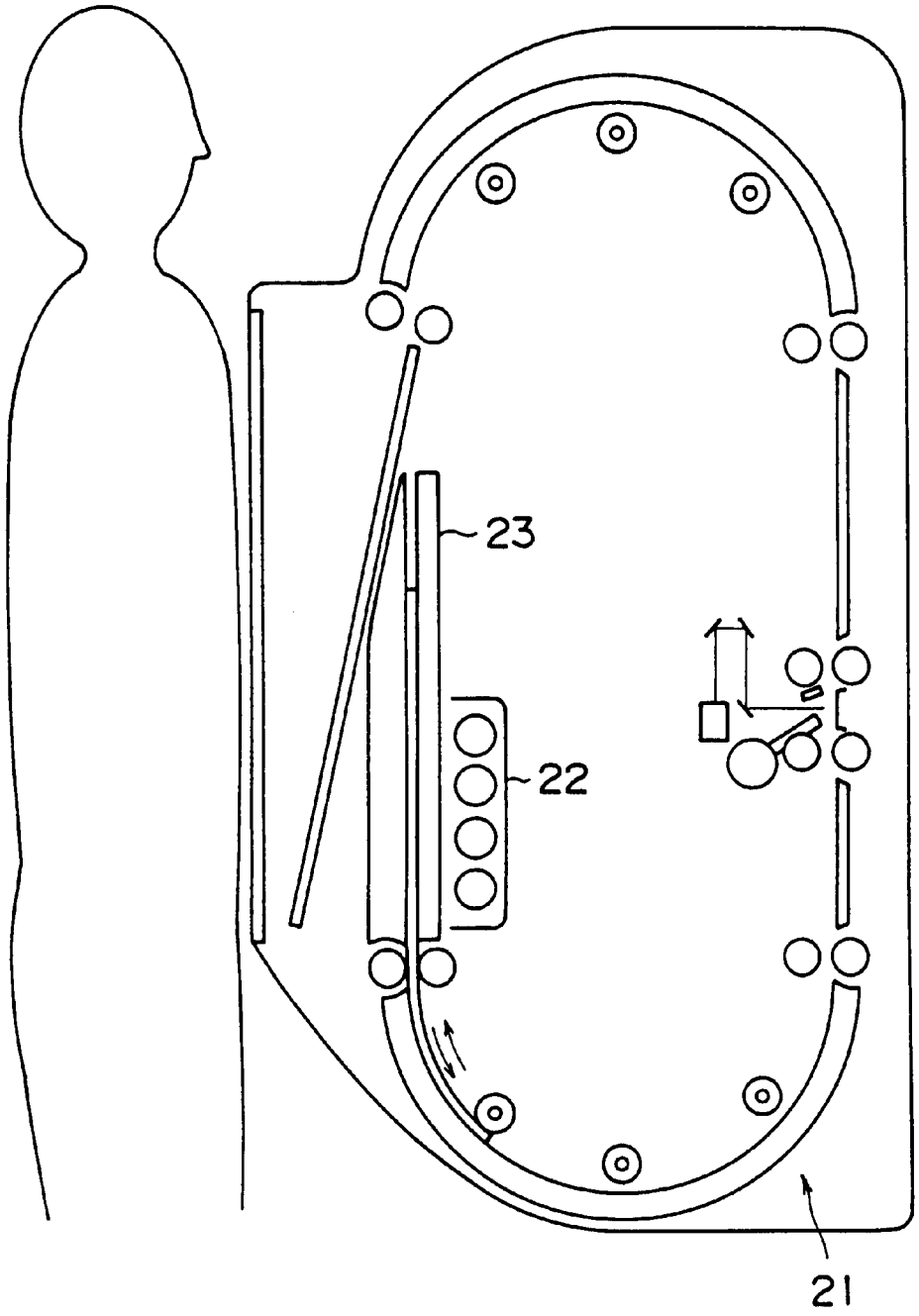
FIG. 5 schematically illustrates an apparatus corresponding to the apparatus of FIG. 1, in which the stimulable phosphor sheet is drawn into the residual radiation image-erasing stage after being subjected to the radiation image reading procedure.

As illustrated in FIG. 5, the phosphor sheet 3 is conveyed from the entrance of the conveying means 21 to the exit with 180-degree turn in the same manner, to be sent into an erasing means 22.

The erasing means 22 is composed of an erasing lamp and a light insulating cover. The erasing means employed in the radiation image recording and reproducing system is already known. The phosphor sheet 3 is introduced in a space between the erasing means 22 and a guide plate 23, and subjected to the erasing procedure.

The phosphor sheet 3 which is subjected to the erasing procedure is then returned back to its original position by conveying along the route in which it was conveyed for performing the radiation image recording and reproducing method. The phosphor sheet 3 returned back to the original position then is kept for waiting for the next X-ray irradiation procedure, as is illustrated in FIG. 1.

There are no specific limitations with respect to the rectangular stimulable phosphor sheet to be conveyed by means of the phosphor sheet-conveying apparatus according to the invention.

A variety of stimulable phosphor sheets are already known. Variations of stimulable phosphor sheets reside in their sizes, compositions, structures, etc. For instance, the stimulable phosphor sheet can have a transparent protective layer on the phosphor layer. The stimulable phosphor sheet may have an auxiliary layer such as a subbing layer, a colored layer or a backing layer. Otherwise, the stimulable phosphor sheet can have a honey comb structure. Any of the known stimulable phosphor sheets can be employed in the conveyance system of the invention.

The radiation image storage panels employable in combination with the conveying apparatus of the invention are now described in more detail.

The stimulable phosphor sheet generally comprises a support film, a stimulable phosphor layer, and a transparent protective film, which are arranged in order.

The support of the phosphor sheet can be optionally selected from those employed in the conventional radiation image storage panels. On the phosphor layer-side surface of the support, one or more auxiliary layers (e.g., light-reflecting layer containing light-reflecting material such as titanium dioxide, light-absorbing layer containing light-absorbing material such as carbon black, adhesive layer comprising polymer material such as gelatin) may be provided, if desired, for improving sensitivity or image quality (sharpness, graininess) or for enhancing bonding strength between the support and the phosphor layer. Further, for improving the sharpness of the reproduced radiation image, fine concaves or convexes may be formed on the phosphor layer-side surface of the support (or on the phosphor layer-side surface of the auxiliary layer, if it is provided). If the phosphor layer is self-supporting, the support may be omitted.

On the support, a phosphor layer comprising a stimulable phosphor is provided. As the stimulable phosphor, preferred is a phosphor giving a stimulated emission of a wavelength in the range of 300 to 500 nm when irradiated with stimulating rays of a wavelength in the range of 400 to 900 nm. In Japanese Patent Provisional Publications No. 2(1990)-193100 and No. 4(1992)-310900, examples of the stimulable phosphor are described in more detail. Examples of the preferred phosphors include divalent europium or cerium activated alkaline earth metal halide phosphors (e.g., BaFBr:Eu, BaFBrI:Eu), and cerium activated oxyhalide phosphors. Needless to say, those examples by no means restrict the invention, and other stimulable phosphors can be employed for the invention.

On the phosphor layer, a transparent protective film is formed. Preferably, the protective film contains light-scattering fine particles dispersed in a binder resin.

The binder resin employable for preparing the protective film is not specifically restricted. Examples of the binder materials include polyethylene terephthalate, polyethylene naphthalate, polyamide, aramid, and fluororesin (i.e., fluorocarbon resin). Preferred is an organic solvent-soluble fluorocarbon resin, which is a polymer of fluoro-olefin (i.e., olefin containing fluorine) or a copolymer comprising fluoro-olefin component. The thickness of the protective film generally is in the range of 1 to 20 $\mu$m, preferably 3.5 to 10 $\mu$m.

Although the conventionally employed stimulable phosphor sheet can be conveyed using a conveying apparatus of the invention, it is preferred that stimulable phosphor layer is not brought into contact with the driving rollers and the guide plate in the course of conveyance. Accordingly, the stimulable phosphor sheet preferably comprises a support film, a stimulable phosphor layer, and a protective film arranged in order, and both of the stimulable phosphor layer and the protective film are missing on both side ends and, preferably, on the missing both side ends are provided with strengthening articles.

Figure 6:
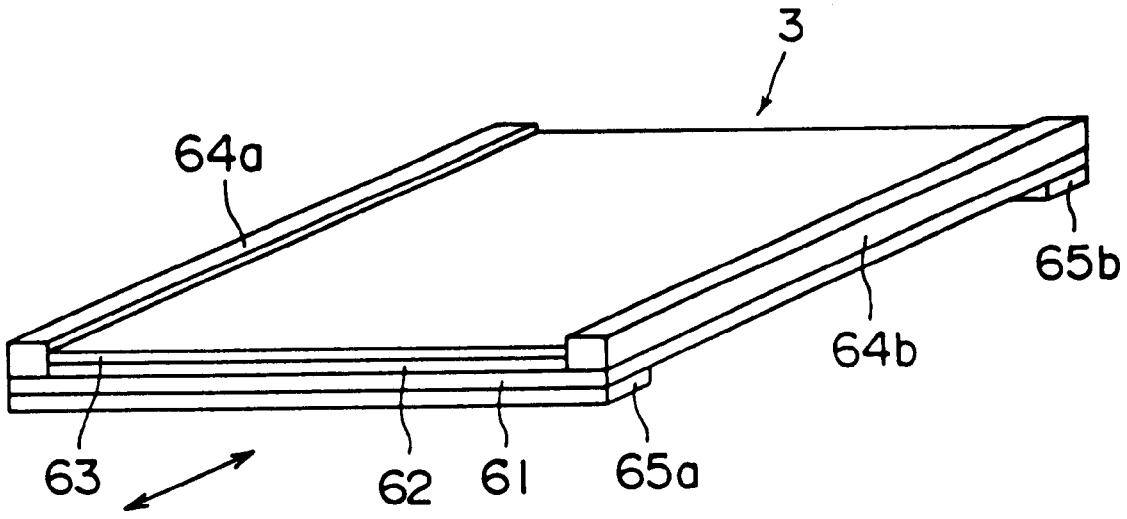
FIG. 6 is a schematic view of one stimulable phosphor sheet which is favorably employed in combination with the conveying apparatus of the invention, for conveying the phosphor sheet with change of its conveyed course.

One representative structure of the preferred stimulable phosphor sheet is illustrated in FIG. 6.

The stimulable phosphor sheet 3 of FIG. 6 comprises a support film 61, a stimulable phosphor layer 62, and a protective film 63 arranged in order, and both of the stimulable phosphor layer 62 and the protective film 63 are missing on both side ends (in which the side ends run along the conveying direction illustrated in FIG. 6 by an arrow) and on the missing both side ends are provided with strengthening articles 64*a,* 64*b.* Each of the strengthening articles 64*a,* 64*b* has a top portion which is protruded on the plane of the upper surface of the protective film 63.

When the phosphor sheet 3 is engaged with the driving rollers 7, 11, the strengthening articles 64*a,* 64*b* are brought into contact with the driving rollers to keep the phosphor layer from physical damage.

The strengthening articles provided on the side portions of the support film are preferably made of flexible material so that the stimulable phosphor sheet can be smoothly conveyed by the conveying apparatus of the invention with sharply turning the conveyed course. Examples of the flexible materials employable for the production of the strengthening articles are polymers such as polyolefins (e.g., high density polyethylene), polyesters (e.g., polyethylene terephthalate and polyethylene naphtalate), and polyamides. The strengthening articles are preferably made of electric-insulating material. The strengthening article can be fixed onto the support film using an adhesive.

The stimulable phosphor sheet of FIG. 6 further comprises a strengthening article on the bach surface of the support film on at least one of the front end and the rear end of the phosphor sheet. The terms of "front" and "rear" are named in consideration of the direction of conveyance of the phosphor sheet in the conveying apparatus of the invention.

It has been noted that the stimulable phosphor sheet is sometimes transformed to give a convex surface at the front end of the sheet in the course of its conveyance in the conveying apparatus of the invention in such manner that the center portion of the front end of the phosphor sheet is protruded from the plane of the conveyed phosphor sheet. The strengthening articles placed on the front and/or rear ends of the phosphor sheet work for reducing the protrusion of the center portion of the phosphor sheet so that the phosphor sheet can be kept from collision against various guide plates.

The strengthening article to be fixed on the front and/or rear ends of the phosphor sheet can be made of ordinary resin material. However, since the strengthening article is preferably a longitudinal plate made of rigid material. The longitudinal plate preferably has a flexural modulus in the range of 5,000 to 50,000 kg/mm$^2$, which is larger in its width direction than in its longitudinal direction. Examples of the preferred materials include sheet of fiber-reinforced plastics (FRP), particularly, glass fiber-reinforced plastics (GFRP), and a carbon fiber-composite sheet. The sheets of the preferred materials can be laminated one on another alternatively changing the direction in which the flexural modulus is larger to give a composite sheets having a high flexural modulus in all directions. The composite sheet may be composed of a metal sheet (e.g., aluminum sheet) or sheets and a plastic sheet or sheets.

The rectangular stimulable phosphor sheet comprising a support film, a stimulable phosphor layer, and a protective film arranged in order, in which at least one of its front end and its rear end is retracted at its center area is also favorably employable in combination with the conveying apparatus of the invention.

Figure 7:
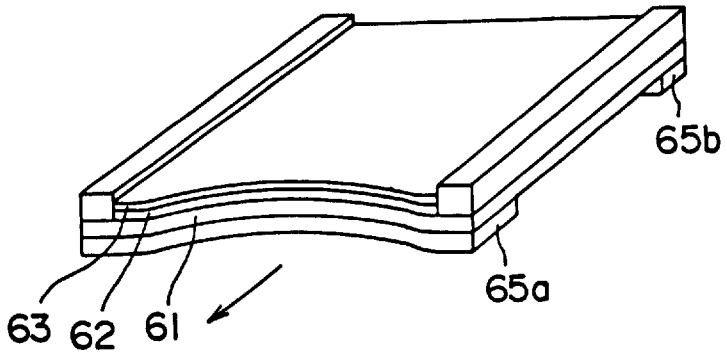
FIG. 7 is a schematic view of another stimulable phosphor sheet which also is favorably employed in combination with the conveying apparatus of the invention, for conveying the phosphor sheet with change of its conveyed course.

FIG. 7 illustrates a representative structure of the stimulable phosphor sheet comprising a support film 61, a stimulable phosphor layer 62, and a protective film 63 arranged in order, in which both of its front end and its rear end are retracted at its center area, and in which both of the phosphor layer and the protective film are missing on both side ends, and on the side ends are provided with strengthening articles, and which further has strengthening articles 65*a,* 65*b* provided on its retracted front end and its retracted rear end of the phosphor sheet. The arrow indicates the direction of conveyance of the phosphor sheet.

Figure 8:
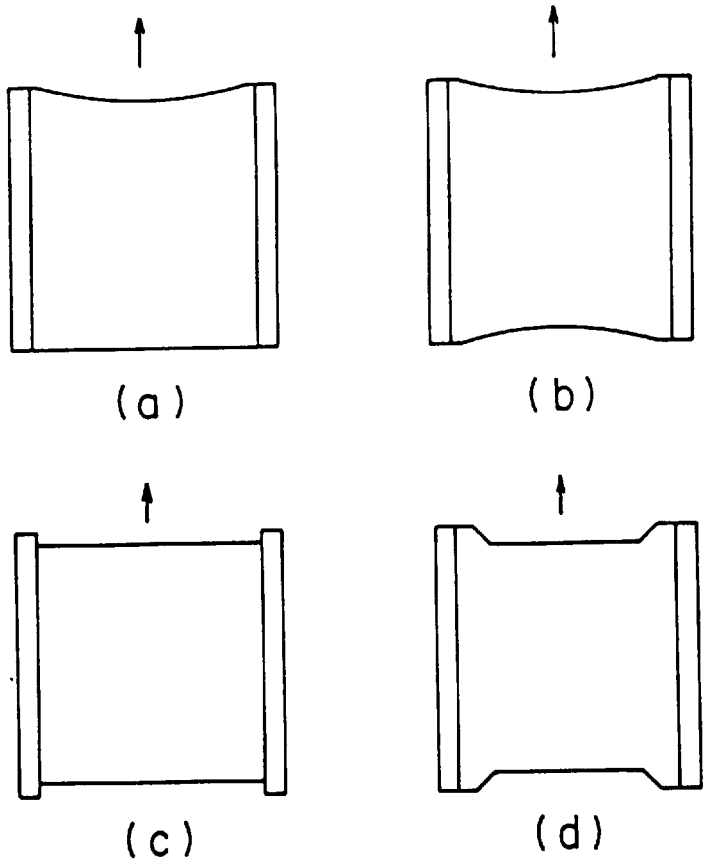
FIG. 8 illustrates variations of the stimulable phosphor sheet of FIG. 7.

FIG. 8 indicates variations (a), (b), (c) and (d) of the retraction of the front and rear ends of the phosphor sheet. The arrows indicate the direction of conveyance of the phosphor sheet.

The strengthening articles fixed onto the side end portions and the strengthening articles fixed onto the front and rear end portions can be produced using the materials described hereinbefore for the description on the phosphor article of FIG. 6.

A rectangular stimulable phosphor sheet comprising a support film, a stimulable phosphor layer, and a protective film arranged in order, in which flexibility in its conveying direction is higher than flexibility in its width direction is also favorably employable in combination with the conveying apparatus of the invention.

Figure 9:
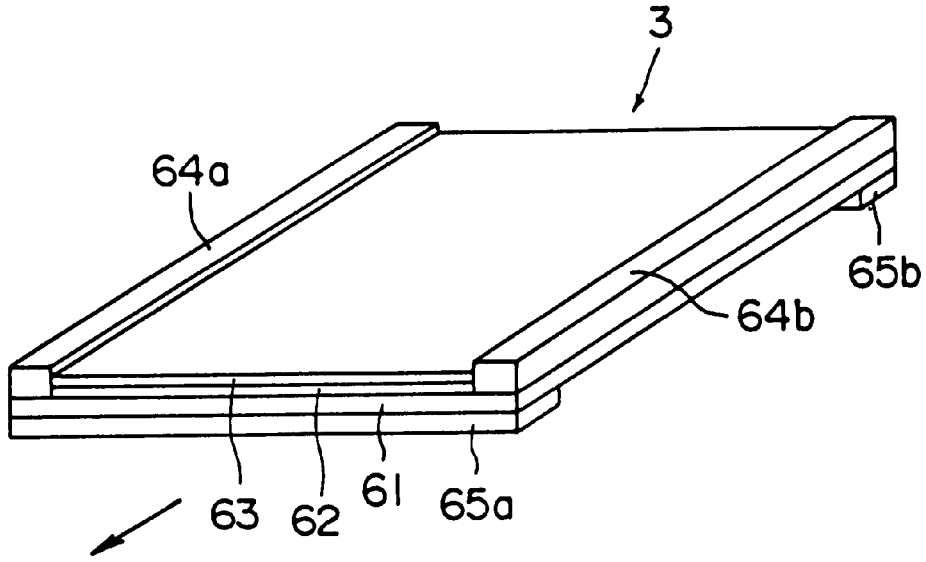
FIG. 9 is a schematic view of a further stimulable phosphor sheet which also is favorably employed in combination with the conveying apparatus of the invention, for conveying the phosphor sheet with change of its conveyed course.

FIG. 9 illustrates a structure of the stimulable phosphor sheet comprising a support film 61, a stimulable phosphor layer 62 and a protective film 63, in which both of the stimulable phosphor layer 62 and the protective film 63 are missing on both side ends, and on the side ends are provided with strengthening articles 64*a,* 64*b,* and which further has a strengthening article 65*a,* 65*b* on the front end as well as the rear end of the phosphor sheet. The combination of the strengthening articles 64*a,* 64*b* on the side end portions and the strengthening articles 65*a,* 65*b* on the front and rear end portions is chosen to give the phosphor sheet whose flexibility in its conveying direction is higher than flexibility in its width direction. The strengthening articles 64*a,* 64*b* placed on the side portions have their top surfaces protruding from the plane of the upper surface of the protective film 63.

Figure 10:
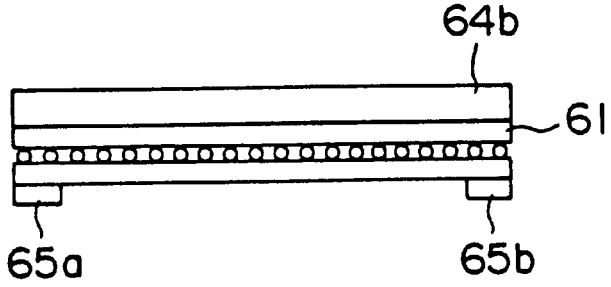
FIG. 10 is a section view of a further stimulable phosphor sheet which also is favorably employed in combination with the conveying apparatus of the invention, for conveying the phosphor sheet with change of its conveyed course.

FIG. 10 illustrates a rectangular stimulable phosphor sheet using a support 61 which is composed of fibrous materials such as glass fibers or carbon fibers which are arranged in parallel to each other in the width direction of the phosphor sheet (which crosses the direction of the conveyance) and which are sandwiched with a pair of plastic films such as polyethylene terephthalate films, so that the flexibility in its conveying direction may be made higher than flexibility in its width direction. The stimulable phosphor sheet of FIG. 10 further has a pair of strengthening articles 64*b* on the side end portion of the phosphor sheet and a pair of strengthening articles 65*a,* 65*b* in the front and rear end portions.

Figure 11:
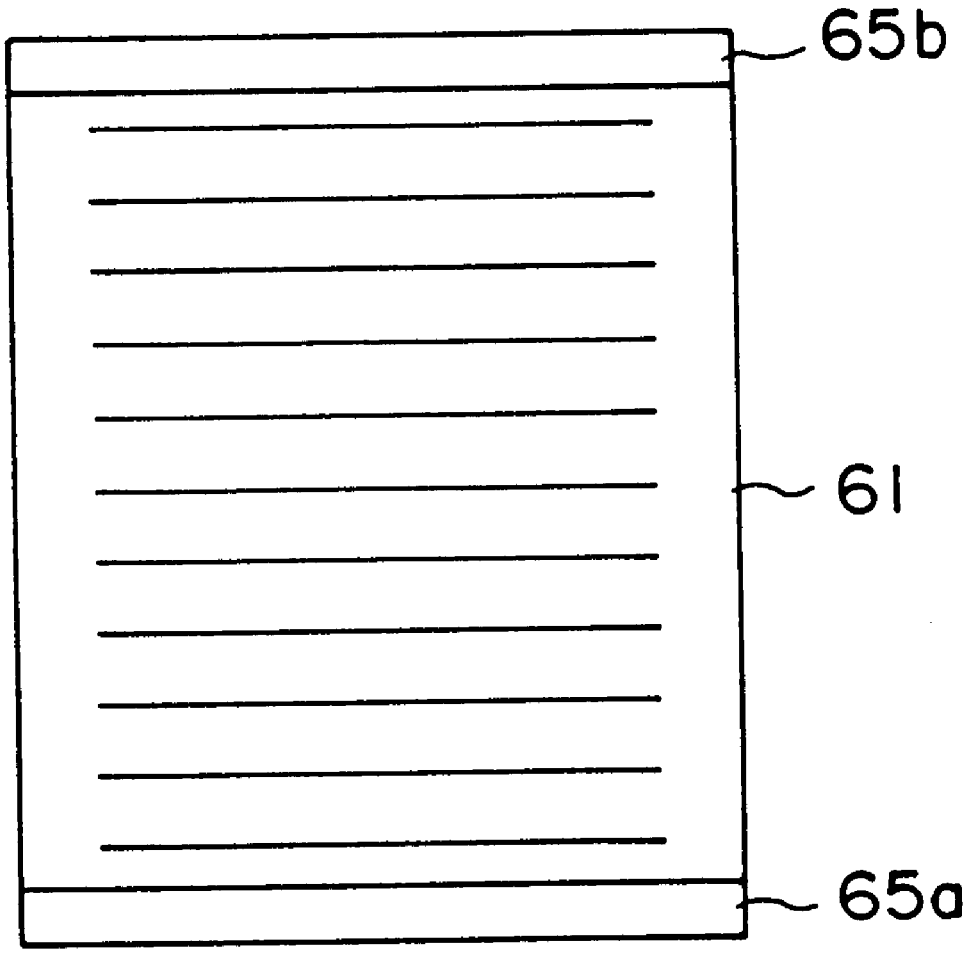
FIG. 11 is a rear view of a further example of the stimulable phosphor sheet which also is favorably employed in combination with the conveying apparatus of the invention, for conveying the phosphor sheet with change of its conveyed course.

The rectangular stimulable phosphor sheet of FIG. 11 has a support film 61 having a back surface provided with a slits arranged in parallel to each other in the width direction of the phosphor sheet (which crosses the direction of the conveyance). The phosphor sheet further has a pair of strengthening articles 65*a,* 65*b* in the front and rear end portions.

What is claimed is:

1. An apparatus for conveying a rectangular stimulable phosphor sheet with change of its conveyed course which comprises:

a pair of longitudinal guide plates curved to form an arc, each guide plate being arranged in parallel to each other with a space approximately corresponding to the width of the phosphor sheet;

a series of rollers which are so arranged along each of the guide plates to allow advancement of the phosphor sheet between a guide space formed by the guide plate and these rollers; and a pair of driving rollers which are arranged in the vicinity of one end on an imaginary plane extended from the pair of the curved guide plates.

2. The apparatus of claim 1, which further comprises another pair of driving rollers which are arranged in the vicinity of another end on an imaginary plane extended from the pair of the curved guide plates.

3. The apparatus of claim 1, wherein both of the driving rollers are able to change its direction of rotation so that the stimulable phosphor sheet can be optionally conveyed forward and backward.

4. A method of conveying a rectangular stimulable phosphor sheet with change of its conveyed course in an apparatus comprising a pair of longitudinal guide plates curved to form an arc, each guide plate being arranged in parallel to each other with a space approximately corresponding to the width of the phosphor sheet; a series of rollers which are so arranged along each of the guide plates to allow advancement of the phosphor sheet between a guide space formed by the guide plate and these rollers; a pair of driving rollers which are arranged in the vicinity of one ends on imaginary plane extended from the pair of the curved guide plates, and another pair of driving rollers which are arranged in the vicinity of another ends on imaginary plane extended from the pair of the curved guide plates which comprises the steps of:

drawing the phosphor sheet into the guide space by rotating the driving rollers arranged in the vicinity of one ends and keeping both sides of the phosphor sheet between the guide space;

advancing the phosphor sheet by continuing the rotation of the driving rollers and keeping both sides of the phosphor sheet between the guide spaces;

advancing the phosphor sheet by rotating the driving rollers arranged in the vicinity of another ends and keeping both sides of the phosphor sheet between the guide spaces; and drawing the phosphor sheet out of the guide spaces by rotating the driving rollers arranged in the vicinity of another ends and keeping both sides of the phosphor sheet between the guide spaces.

5. The method of claim 4, in which the stimulable phosphor sheet comprises a support film, a stimulable phosphor layer, and a protective film arranged in order, and both of the stimulable phosphor layer and the protective film are missing on both side ends and on the missing both side ends are provided with strengthening articles.

6. A method of conveying a rectangular stimulable phosphor sheet whose forward end is retracted at its center area, with change of its conveyed course in an apparatus comprising a pair of longitudinal guide plates curved to form an arc, each guide plate being arranged in parallel to each other with a space approximately corresponding to the width of the phosphor sheet; a series of rollers which are so arranged along each of the guide plates to allow advancement of the phosphor sheet between a guide space formed by the guide plate and these rollers; a pair of driving rollers which are arranged in the vicinity of one ends on imaginary plane extended from the pair of the curved guide plates, and another pair of driving rollers which are arranged in the vicinity of another ends on imaginary plane extended from the pair of the curved guide plates which comprises the steps of:

drawing the phosphor sheet into the guide space by rotating the driving rollers arranged in the vicinity of one ends and keeping both sides of the phosphor sheet between the guide space;

advancing the phosphor sheet by continuing the rotation of the driving rollers and keeping both sides of the phosphor sheet between the guide spaces;

advancing the phosphor sheet by rotating the driving rollers arranged in the vicinity of another ends and keeping both sides of the phosphor sheet between the guide spaces; and drawing the phosphor sheet out of the guide spaces by rotating the driving rollers arranged in the vicinity of another ends and keeping both sides of the phosphor sheet between the guide spaces.

7. The method of claim 6, in which the stimulable phosphor sheet comprises a support film, a stimulable phosphor layer, and a protective film arranged in order, and both of the stimulable phosphor layer and the protective film are missing on both side ends, and on the missing both side ends are provided with strengthening articles.

8. A method of conveying a rectangular stimulable phosphor sheet whose flexibility in its conveying direction is higher than flexibility in its width direction, with change of its conveyed course in an apparatus comprising a pair of longitudinal guide plates curved to form an arc, each guide plate being arranged in parallel to each other with a space approximately corresponding to the width of the phosphor sheet; a series of rollers which are so arranged along each of the guide plates to allow advancement of the phosphor sheet between a guide space formed by the guide plate and these rollers; a pair of driving rollers which are arranged in the vicinity of one ends on imaginary plane extended from the pair of the curved guide plates, and another pair of driving rollers which are arranged in the vicinity of another ends on imaginary plane extended from the pair of the curved guide plates which comprises the steps of:

drawing the phosphor sheet into the guide space by rotating the driving rollers arranged in the vicinity of one ends and keeping both sides of the phosphor sheet between the guide space;

advancing the phosphor sheet by continuing the rotation of the driving rollers and keeping both sides of the phosphor sheet between the guide spaces;

advancing the phosphor sheet by rotating the driving rollers arranged in the vicinity of another ends and keeping both sides of the phosphor sheet between the guide spaces; and drawing the phosphor sheet out of the guide spaces by rotating the driving rollers arranged in the vicinity of another ends and keeping both sides of the phosphor sheet between the guide spaces.

9. The method of claim 8, in which the stimulable phosphor sheet comprises a support film, a stimulable phosphor layer, and a protective film arranged in order, and both of the stimulable phosphor layer and the protective film are missing on both side ends, and on the missing both side ends are provided with strengthening articles.

* * * * *